US008496143B1

(12) United States Patent
Joseph

(10) Patent No.: US 8,496,143 B1
(45) Date of Patent: Jul. 30, 2013

(54) PERSONAL COAT CARRIER

(76) Inventor: Ronald L. Joseph, Blackhawk, CO (US)

( * ) Notice: Subject to any disclaimer, the term of this patent is extended or adjusted under 35 U.S.C. 154(b) by 137 days.

(21) Appl. No.: 13/066,666

(22) Filed: Apr. 20, 2011

(51) Int. Cl.
*A45F 3/14* (2006.01)
*A45F 5/00* (2006.01)

(52) U.S. Cl.
USPC ..... 224/257; 224/201; 224/628; 224/666; 224/925; 224/927; 224/268

(58) Field of Classification Search
USPC ..... 224/257, 621, 666, 667, 668, 268, 224/269, 627, 925, 927, 910, 201, 628, 633
See application file for complete search history.

(56) References Cited

U.S. PATENT DOCUMENTS

| | | | | |
|---|---|---|---|---|
| 1,884,328 | A | 10/1932 | Spebling | |
| 2,643,803 | A * | 6/1953 | Bates | 224/254 |
| 2,760,699 | A | 8/1956 | Rivers-McPherson | |
| 4,280,645 | A | 7/1981 | Goodden | |
| 4,480,775 | A * | 11/1984 | Stanford | 224/635 |
| 4,764,962 | A | 8/1988 | Ekman et al. | |
| 5,263,618 | A | 11/1993 | Talavera | |
| 5,540,364 | A | 7/1996 | Krieger | |
| 5,890,227 | A * | 4/1999 | Brown | 2/102 |
| 6,041,945 | A * | 3/2000 | Faraj | 211/12 |
| 6,637,547 | B1 | 10/2003 | Wydner | |
| 6,832,711 | B2 * | 12/2004 | Black | 224/628 |
| 6,976,614 | B1 * | 12/2005 | Caramanis | 224/255 |
| 7,275,668 | B1 * | 10/2007 | Carroll | 224/190 |
| 7,394,008 | B2 * | 7/2008 | May | 84/421 |
| 2002/0125278 | A1 * | 9/2002 | Wagmild | 224/268 |
| 2003/0125170 | A1 * | 7/2003 | Vernon | 482/124 |
| 2006/0208024 | A1 * | 9/2006 | Gleason | 224/633 |
| 2007/0083975 | A1 * | 4/2007 | Senegal | 2/102 |
| 2008/0156834 | A1 * | 7/2008 | Tipaldo | 224/258 |
| 2009/0242598 | A1 * | 10/2009 | Dormaar | 224/257 |

* cited by examiner

*Primary Examiner* — Nathan J Newhouse
*Assistant Examiner* — Matthew Theis
(74) *Attorney, Agent, or Firm* — Ramon L. Pizarro; Edwin W. Crabtree

(57) ABSTRACT

A coat or personal item carrier that is worn by a person is disclosed. An example of personal item carrier includes at least one elongated flexible strap, the elongated flexible strap having a first end, a second end, and a mid section, the first end and the second end each including a waist connector that is adapted for engaging the waist portion of the user's garment. A coat hook is attached to the elongated flexible strap at about the mid section of the elongated flexible strap so that the coat hook is positioned over the wearer's back when the elongated flexible strap is worn as disclosed. The coat hook or coat hooks are used to support personal items such as coats, purses, or other items that would otherwise have to be carried in the person's arms.

7 Claims, 5 Drawing Sheets

PERSONAL COAT CARRIER

BACKGROUND OF THE INVENTION (a) Field of the Invention

This application relates to a system and method for carrying personal items, such as coats and purses, when not being worn. More particularly, but not by way of limitation, to a flexible support system that provides attachment points for carrying items on the user's back, and which can be folded or rolled up to a compact size, and used to support the personal items from the wearer's back or from a support hook mounted from a support surface such as a wall.

(b) Discussion of Known Art

Outdoor activities require that one be prepared for the elements. Often, a person may attend all-day events such as a fair, or an outdoor market, which starts during cool morning temperatures and extends into the afternoon, when temperatures and conditions may have changed significantly. Similarly, families may go for walks with children or even walk from a parked car into a mall where the conditions inside the mall differ greatly from the conditions outside the mall. These types of situations often require that one wear a coat or other outerwear when commencing the activity, and then have to carry the coat or outerwear for much of the day. Carrying a coat in one's arms is a well-known inconvenience; an inconvenience that often leads to misplaced jackets or other personal items, such as purses, and loss of items that simply fall out of the jacket, such as keys or wallets. Accordingly, there remains a need for a device that helps individuals carry one or more personal items, and importantly, carry one or more personal items in a manner that will not result in things falling out of the item being carried, and which will not result in wrinkling or making the items difficult to access, as occurs when stuffing items into a backpack.

Similarly, prudent motorcycle riding requires the use of appropriate garments that will protect the rider in the event of an accident. A leather or heavy jacket has long been considered as providing adequate protection for the rider. However, since motorcycle riding is typically limited to days of good weather, the jacket worn by the motorcycle rider becomes a burden once the rider has reached his destination and parked the motorcycle. Since the weather is nice, the continued use of the jacket after dismounting can be uncomfortable, and carrying the jacket in one's arm is heavy and cumbersome.

Many motorcycles are equipped with saddlebags that provide limited storage space, and which often do not include adequate locking mechanisms. Additionally, the limited space and limited security afforded by a saddlebag makes it undesirable or unfeasible for motorcycle riders to leave their jackets in the saddlebags or with the motorcycle when not using the motorcycle.

Carrying personal items, such as a jacket, on a person's back has long been accomplished through the use of a backpack that is used to hold the personal items. However, when the personal item to be carried is a motorcycle-riding jacket, the use of a backpack as the means for carrying the garment has significant limitations. One important limitation is that the bulk of the jacket will take up much if not all of the storage space in the backpack. Another limitation is that if several jackets are to be carried, which is likely to be the case when two people are traveling on the motorcycle, the jackets are unlikely to fit in a single backpack, and access to items that may have been left in either of the jackets will require the emptying of the backpack.

Still further, depending on a backpack to carry motorcycle jackets when away from the motorcycle means that the backpack must be stored when riding the motorcycle. Given the limited carrying space available on a motorcycle, the reliance on a backpack for carrying jackets while not riding the motorcycle is not an adequate solution.

Therefore, there remains a need for a simple device that allows individuals to carry their jackets and other belongings when not using their jackets or other personal items, such as purses. Importantly, there remains a need for a device that takes up very little space when not in use, and which can be used to carry several jackets together with other items, such as purses, while providing easy access to these items at the same time. Still further, there remains a need for a system that allows one to carry personal items, such as garments, without wrinkling the items, as would occur by stuffing the items in a backpack.

SUMMARY

It has been discovered that the problems left unanswered by known art can be solved by providing a personal coat carrier to be worn by a person while the person is wearing a garment having a waist portion, the carrier comprising:

At least one elongated flexible strap, the elongated flexible strap having a first end, a second end, and a mid section, the first end and the second end each including a waist connector that is adapted for engaging the waist portion of the user's garment; and A first coat hook, the first coat hook being attached to the elongated flexible strap at mid section of the elongated flexible strap.

It is contemplated that a rigid support bar will be attached to the elongated flexible strap at the location of the attachment of the first coat hook. The first coat hook would be attached to the rigid support bar, either directly or through the elongated flexible strap. Thus, if the coat hook is not attached directly to the rigid support bar, then it may be attached directly to the elongated support strap, which is in-turn attached to the rigid support bar. Thus the elongated support strap may be sandwiched between the rigid support bar and the coat hook or may be attached between the rigid support bar and the first coat hook.

Additionally, it is contemplated that a retention strap will be attached to the elongated flexible strap at a location between the first coat hook and one of the waist connectors, such that a coat or other item suspended from the coat hook may be retained against the elongated flexible strap by the retention strap.

Also, it is contemplated that the disclosed invention will be assembled using a pair of the elongated flexible straps, the elongated flexible straps being separated by a strap or preferably a single rigid support bar that extends between the two elongated flexible straps. In this embodiment, a fabric or pliable section with an opening for accepting the user' head extends between the pair of elongated flexible straps and allows the user to wear a personal coat carrier like a poncho.

Still further, it is contemplated that the disclosed invention may include padding for the wearer's shoulders, as well as incorporate stabilization straps serve to retain the relationship the pair of elongated flexible straps, when this embodiment is used.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
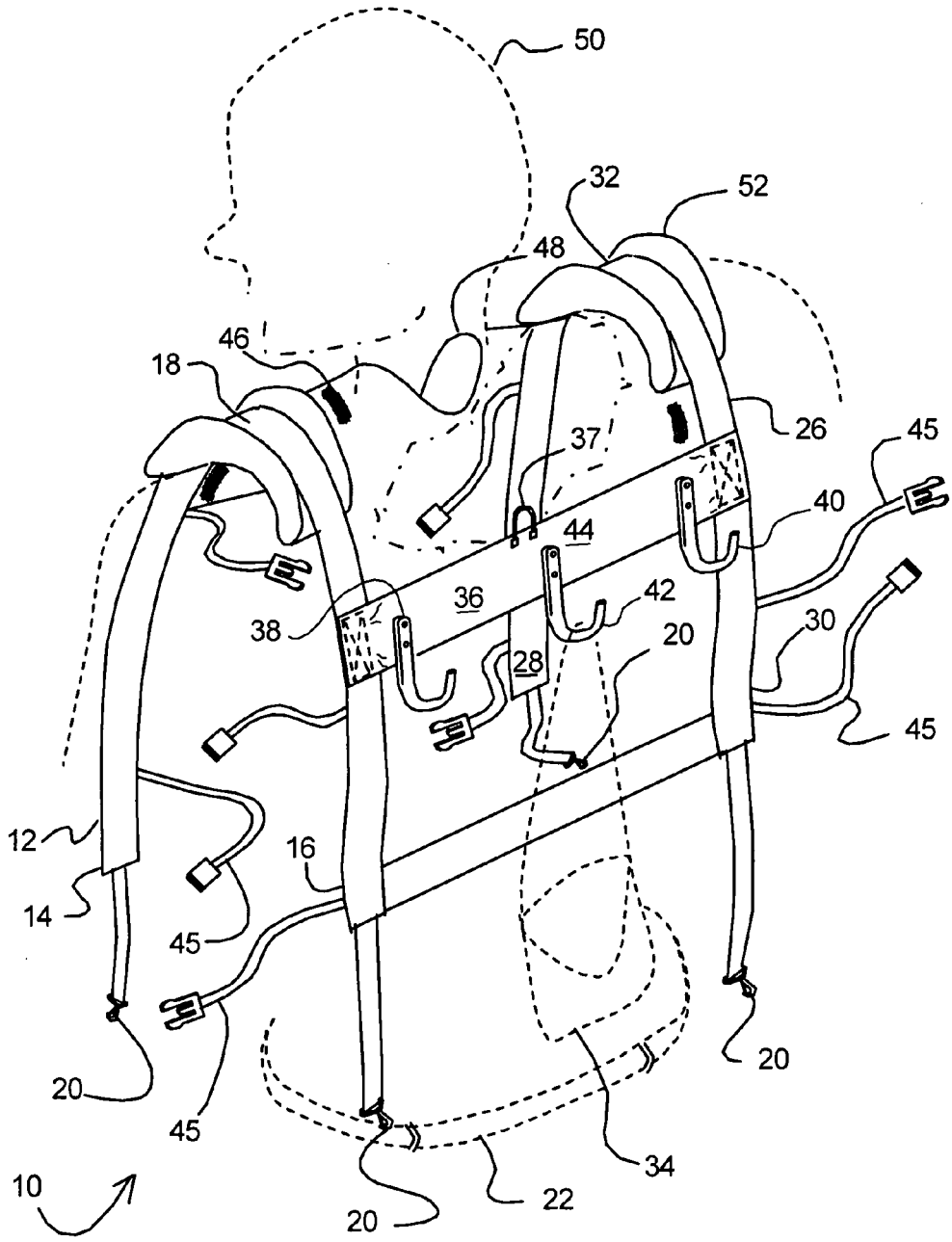
FIG. 1 is a perspective view of an embodiment of the invention while in use, the embodiment incorporating a pair of elongated flexible straps that are spaced apart to provide support for three coat hooks.
Figure 4:
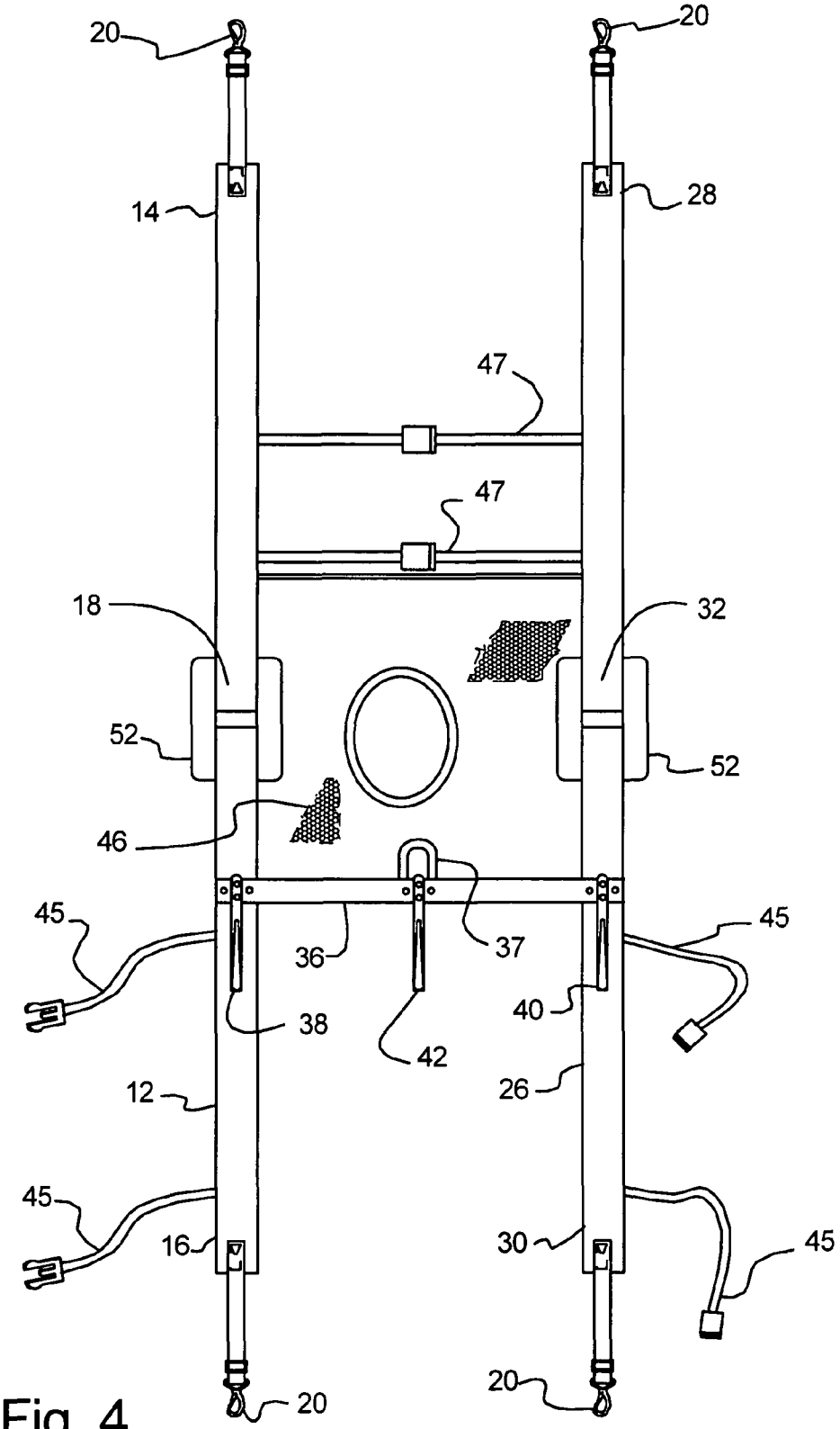
FIG. 4 is a plan view of the main components of the embodiment illustrated in FIG. 1.

Turning now to FIGS. 1 and 4 where a preferred embodiment of a personal coat carrier 10 made in accordance with the principles disclosed here has been illustrated. FIG. 1 illustrates the device while in use, while FIG. 4 illustrates the disclosed invention while laid out over a flat surface. It will be understood from these figures that the personal article carrier 10 is preferably worn over a person's shoulders, and used to carry personal items such as jackets, purses, or other items when not in use. Accordingly, the disclosed invention will free the user's hands while allowing the user to carry the personal items without wrinkling or packing them in a manner that would make it difficult to access a specific personal item.

FIGS. 1 and 4 disclose that a preferred construction of the disclosed invention will use a first elongated flexible strap 12 that includes a first strap first end 14, a first strap second end 16, and a first strap mid section 18. The first strap first end 14 and the first strap second end 16 each including a waist connector 20 that is adapted for engaging the waist portion 22 of the user's garment 24.

Also illustrated in FIGS. 1 and 4 is that this example of the disclosed invention includes a second elongated flexible strap 26. The second elongated flexible strap 26 is preferably spaced apart from the first elongated flexible strap 12 in a generally parallel fashion from the first elongated flexible strap 12. Additionally, the second elongated flexible strap 26 also includes a second strap first end 28, a second strap second end 30, and a second strap mid section 32. The second strap first end 28 and the second strap second end 30 each include a waist connector 20 that is adapted for engaging the waist portion 22 of the user's garment 24, in the same fashion as accomplished with the waist connectors 20 used on the first elongated flexible strap 12.

In order to support personal items 28, a substantially rigid support bar 30 is attached to the first elongated flexible strap 12 near the first strap mid section 18 and to the second elongated flexible strap at a location near the second strap mid section 32 and to the second elongated flexible strap 26 near the second strap mid section 32. Thus, it will be understood that with this arrangement the first elongated flexible strap 12 and the second elongated flexible strap 26 will be held in a spaced apart relation to one another by the substantially rigid support bar 36. The substantially rigid support bar 36 may be made from steel, aluminum, plastic, plastic composite or similar material, and may be a substantially rigid material that is encased in a fabric sleeve, which would allow sown connection to the elongated flexible straps. It is contemplated that the support bar may be made of a flexible material, provided that a stabilizing bar is positioned between the support bar and the first elongated flexible strap 12 and the second elongated flexible strap 26 at a location between the mid-portion and the first end of each of these straps. Additionally, it is contemplated that a loop 37 for hanging the personal coat carrier 10 from a wall-mounted hook or similar device.

Figure 2:
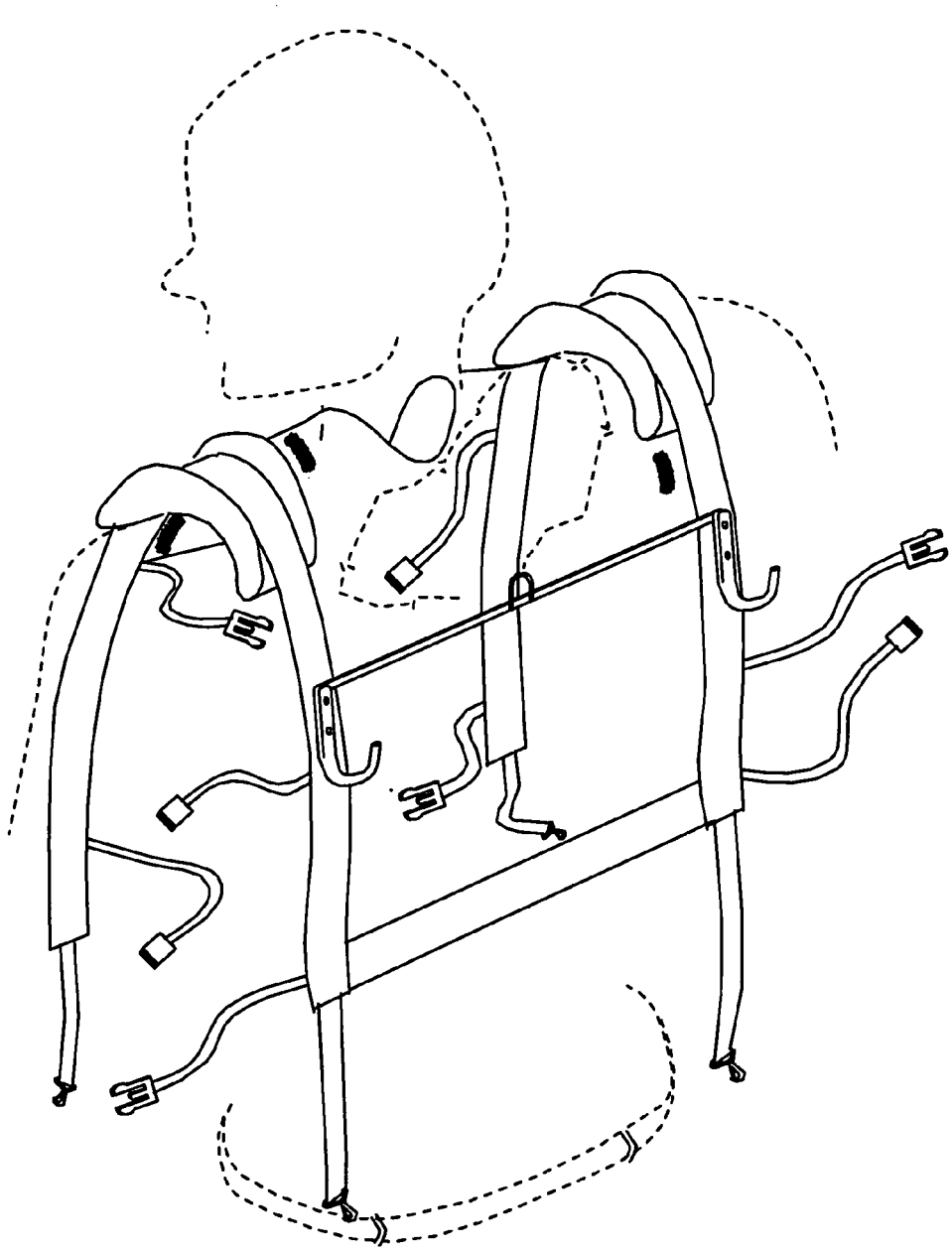
FIG. 2 is a perspective view of an embodiment of the invention while in use, the embodiment incorporating a pair of elongated flexible straps that are spaced apart with a rigid bar to provide support for a pair coat hooks.

FIGS. 1, 2 and 4 illustrate that a first coat hook 38 is attached to the first elongated flexible strap 12 near the first strap mid section 18, preferably near or over the substantially rigid support bar 36. Additionally, these figures also illustrate that a preferred embodiment of the disclosed invention would include a second coat hook 40 that is attached to the second elongated flexible strap 26 at a location that is near the second strap mid section 32, and near or over the substantially rigid support bar 36. This arrangement will allow the disclosed personal item, or coat, carrier to support a pair of garments or items, one from the fist coat hook 38 and another from the second coat hook 4. The weight of the garments or items being transmitted through the first elongated flexible strap 12 and the second elongated flexible strap 26 over the person's shoulders and to the waist portion 22 of the person's garment 24.

It is important to note that the accompanying illustrations show that the attachment to the waist portion 22 of the person's garment 24 is accomplished through the use of the waist connectors 20, which may be hooks that wound engage the garment 24, such as at a belt loop, or may be a clip, or a looped structure, which would allow the user to pass a belt through the waist connectors 20, and thus provide better distribution of the load.

FIGS. 1, and 4 also illustrate the use of a third coat hook 42 that is attached to the substantially rigid support 36 bar at a location 44 between the first elongated flexible strap 12 and the second elongated flexible strap 26.

Referring now to FIGS. 1-5 it will be understood that a preferred embodiment of the invention will include a retention strap 45, or set of retention straps 45, attached to either of the elongated flexible straps at a location between the first coat hook 38 and one of the waist connectors 20. This will allow tight retention of a coat or other item suspended from the coat hook against the elongated flexible strap, and thus further secure the item to the disclosed invention in order to prevent loss through accident or theft. Additionally, front straps 47 may also be attached to the first elongated flexible strap 12 and the second elongated flexible strap 26

Referring to FIGS. 1, 2, and 4 it will be understood that a fabric section 46 that extends between the first elongated flexible strap 12 and the second elongated flexible strap 26 may be used to stabilize or maintain the spacing of the first elongated flexible strap 12 and the second elongated flexible strap 26. The fabric section 46 will preferably include an opening 48 that has been adapted for accepting the user' head 50 through the opening. Still further, FIGS. 1-5 illustrate that a preferred example of the invention incorporate the use of a pad 52 that is adapted for resting over the person's shoulder and below the elongated flexible straps.

Figure 3:
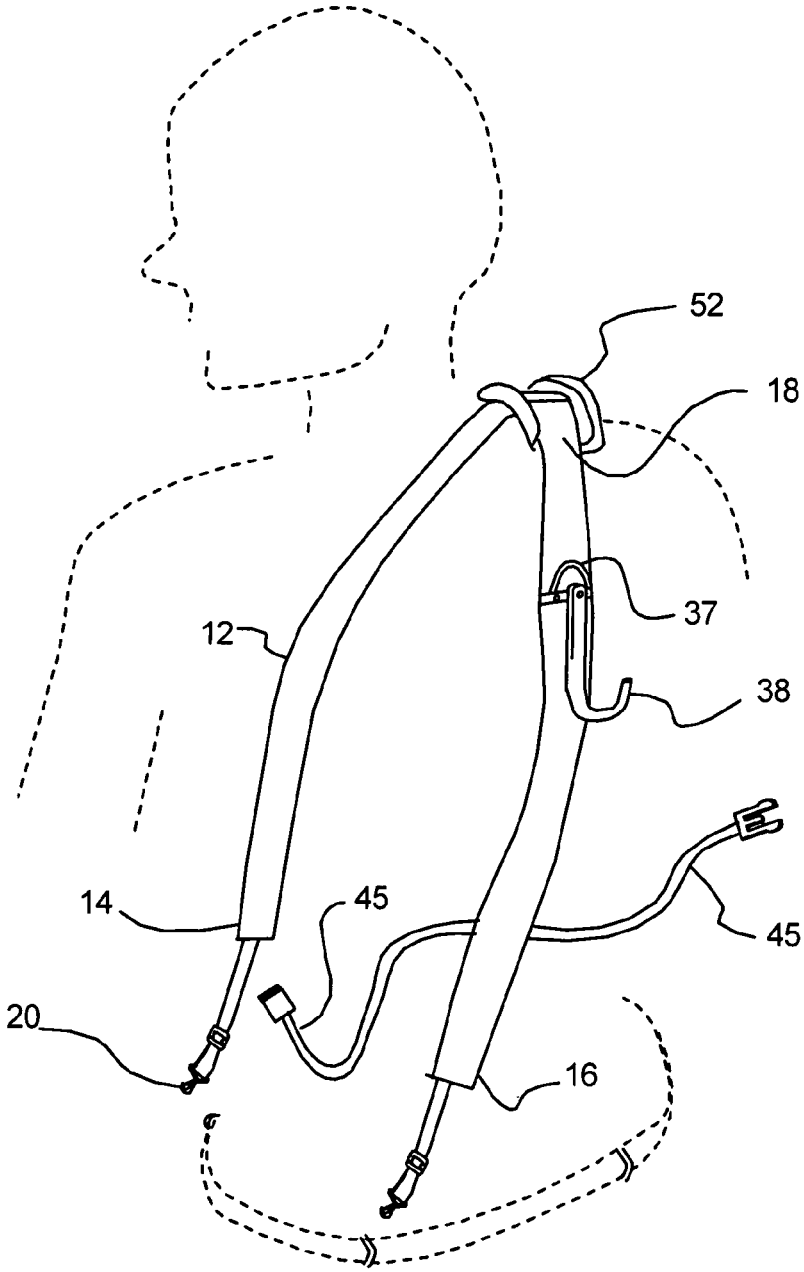
FIG. 3 is a perspective view of an embodiment of the invention while in use, the embodiment using a single elongated flexible strap.
Figure 5:
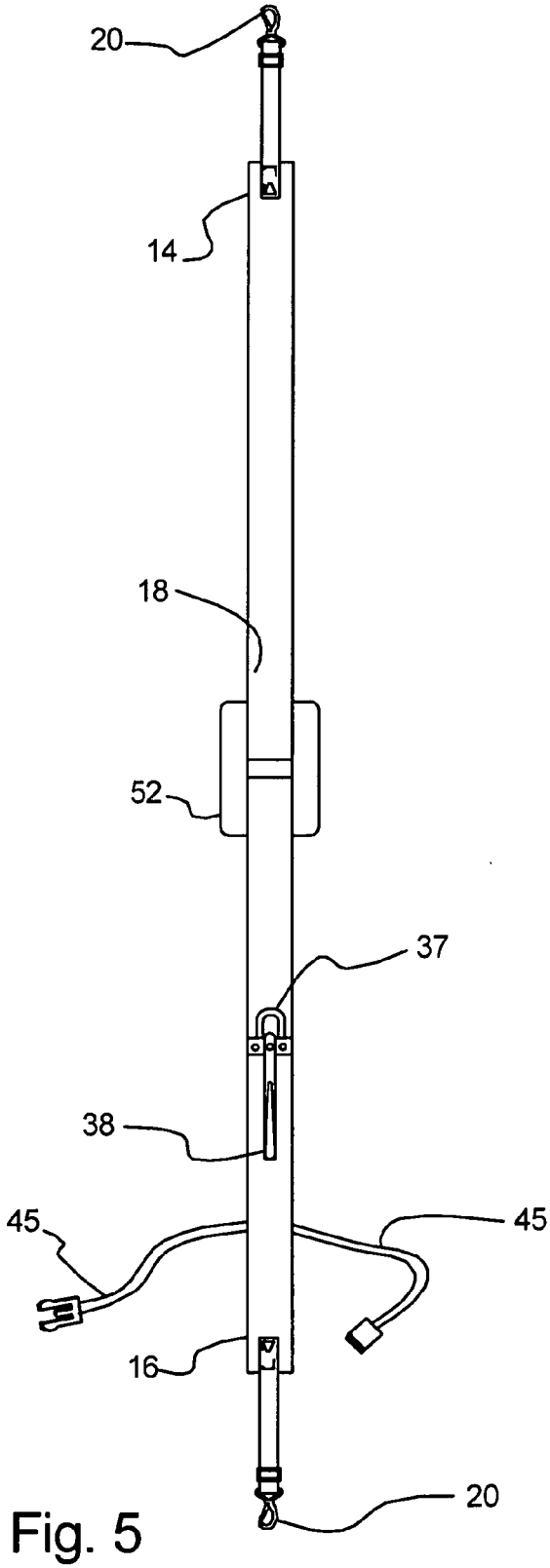
FIG. 5 is a plan view of the main components of the embodiment illustrated in FIG. 2.

In a simplified form, illustrated in FIGS. 3 and 5, the disclosed invention may be practiced by using a single first flexible strap 12, with the first coat hook 38, and the set of retention straps 45. Additionally, the pad 52 and waist connectors 20 will also be used for the purposes described above.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. An article carrier to be worn over a person's shoulders while the person is wearing a garment having a waist portion, the article carrier comprising:

a first elongated flexible strap, the first elongated flexible strap having a first strap first end, a first strap second end, and a first strap mid section, the strap first end and the first strap second end each including a waist connector that is adapted for engaging the waist portion of the user's garment;

a second elongated flexible strap, the second elongated flexible strap being spaced apart in a generally parallel fashion from the first elongated flexible strap, the second elongated flexible strap having a second strap first end, a second strap second end, and a second strap mid section, the second strap first end and the second strap second end each including a waist connector that includes a J-shaped hook;

a substantially rigid support bar that is attached directly to the first elongated flexible strap against the first strap mid section of the first elongated flexible strap and directly to the second elongated flexible strap against the second strap mid section, so that the first elongated flexible strap and the second elongated flexible strap are held in a spaced apart relation to one another by the substantially rigid support bar, so that the first strap and the second strap may be wrapped around the substantially rigid support bar when the article carrier is not in use;

a first coat hook, the first coat hook being attached to the first elongated flexible strap near the first strap mid section and over the substantially rigid support bar;

a second coat hook, the second coat hook being attached to the second elongated flexible strap near the second strap mid section and over the substantially rigid support bar, so that the article may be supported from the first coat hook or the second coat hook when the first elongated flexible strap and the second elongated flexible strap are extended over the person's shoulders and attached to the waist portion of the person's garment.

2. An article carrier according to claim 1 wherein a third coat hook is attached to the substantially rigid support bar between the first elongated flexible strap and the second elongated flexible strap.

3. An article carrier according to claim 1 and further comprising a retention strap that is attached to the elongated flexible strap at a location between the rigid support bar and one of the waist connectors, so that a coat or other item suspended from the coat hook may be retained against the elongated flexible strap by the retention strap.

4. An article carrier according to claim 2 and further comprising a loop that is attached to the substantially rigid support bar at a location between the first elongated flexible strap and the second elongated flexible strap.

5. An article carrier according to claim 3 and further comprising a second coat hook, the second coat hook being attached to the second elongated flexible strap near the second strap mid section.

6. An article carrier according to claim 5 and further comprising a fabric section that extends between the first elongated flexible strap and the second elongated flexible strap, and between the rigid support bar and the first strap first end and the second strap first end, and against the first strap mid section and the second strap mid section, the fabric section having an opening adapted for accepting the person's head between the first strap mid section and the second strap mid section.

7. An article carrier according to claim 5 and further comprising a pad located against the first strap mid section and a pad against the second strap mid section the pads being adapted for positioning over the person's shoulder and below the first strap mid section and below the second strap mid section.

* * * * *